US006299487B1

(12) United States Patent
Lopata et al.

(10) Patent No.: US 6,299,487 B1
(45) Date of Patent: Oct. 9, 2001

(54) CONNECTOR WITH WEAR-RESISTANT ENGAGEMENT MEANS

(75) Inventors: John E. Lopata; Kirk B. Peloza; Yew Teck Yap; Timothy E. Purkis, all of Naperville; Jose H. Chavez, Jr., Romeoville, all of IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/541,208

(22) Filed: Apr. 3, 2000

(51) Int. Cl.[7] ..... H01R 9/03
(52) U.S. Cl. ..... 439/610; 439/607
(58) Field of Search ..... 439/607–610, 439/108

(56) References Cited

U.S. PATENT DOCUMENTS 5,254,010 * 10/1993 Davis ..... 439/609 X
5,397,246 * 3/1995 Defibaugh et al. ..... 439/607 X
5,676,569 10/1997 Davis ..... 439/731
6,027,375 * 2/2000 Wu ..... 439/607
6,062,907 * 5/2000 Tan et al. ..... 439/610
6,086,421 * 7/2000 Wu et al. ..... 439/607

* cited by examiner

*Primary Examiner*—Tulsidas Patel
*Assistant Examiner*—Son V. Nguyen
(74) *Attorney, Agent, or Firm*—Robert J. Zeitler; Thomas D. Paulius

(57) ABSTRACT

A connector is formed with a metal shell for use as a shield of the connector. The shell has a pair of tab members formed along its front face that are stamped to provide two metal contact points. These tabs are engaged by metal contact arms formed on a shield of an opposing connector. The metal to metal contact that results from the tab members decreases wear and abrasion and also serves as a conductive connection between the two connector shields.

9 Claims, 5 Drawing Sheets

CONNECTOR WITH WEAR-RESISTANT ENGAGEMENT MEANS

BACKGROUND OF THE INVENTION

The present invention relates generally to plug and receptacle connectors, and more particularly to a connector having an engagement means that is wear resistant and which provides a point of shielding contact.

Plug and receptacle connectors are commonly used to connect electrical transmission cables to electrical components. Often these connectors employ a plug connector terminated to the transmission cable and a receptacle connector terminated to a circuit board. In these connectors, the plug connector typically has a recessed shield within an insulative housing that engages a shielded housing of the receptacle. This engagement typically involves metal to plastic contact. Metal engagement arms on one connector will engage an opposing plastic surface of the other connector prior to engaging the recessed shield. This plastic to metal contact may result in abrasion and wear of the plastic mating surfaces and deterioration of the mating engagement arms of the shield to the point where the engagement of the two connectors is compromised. Furthermore, debris created by the wearing of the plastic mating surfaces could adversely affect the electrical performance of the connectors.

Furthermore, when such connectors are used in high speed data transmission applications, the amount of electromagnetic or radio frequency interference increases. This may be reduced by shielding. One solution to this problem has been to use a capacitive gasket. However, this solution is costly and requires additional space in the connector system. It is therefore desirable to provide a connector system that is wear-resistant and which provides shielding against the aforementioned interference.

The present invention is directed to a connector system and connect that overcomes the aforementioned shortcomings of the prior art.

SUMMARY OF THE INVENTION

It is therefore a general object of the present invention to provide a plug connector for engaging a receptacle connector wherein the opposing engagement surfaces of the two connectors are formed from a wear-resistant material, such as a metal.

Another object of the present invention is to provide a first connector for engaging a second connector wherein the engagement surfaces for both connectors are formed of metal and which define points of conductive engagement between shield members of the two connectors.

A further object of the present invention is to provide a plug connector having a metal shield integrated therewith, the shield having tab members integrally formed therewith that extend outwardly therefrom to present metal engagement surfaces that are engaged by opposing metal engagement arms of the opposing connector, the tab members also providing points of conductive contact between the shields of the two connectors.

These and other objects are accomplished through the unique and novel structure of the present invention.

In one principal aspect of the present invention, a plug connector is provided with an elongated metal shell that extends for substantially the entire longitudinal extent of the connector. This shell provides an electromagnetic or radio frequency interference shield for the connector, but it also has a pair of end tabs formed along its mating face. These tabs extend outwardly at a slight radius and are preferably embedded in the sidewalls of the connector housing during over molding. The tabs extend in opposition to a pair of engagement arms of the shield of an opposing receptacle connector and thereby provide metal-to-metal contact between the two connectors.

The tab members of the plug connector are formed as part of the overall connector shield and also provide a means for electrically connecting the two connector shields together. These points of engagement are formed lengthwise along the connectors and, as such, they do not overly increase the size of the connectors. The tab members may be formed with a slight radius to define an arcuate surface that the engagement arms of the receptacle connector can engage.

These and other objects, features and advantages of the present invention will be clearly understood through consideration of the following detailed description.

BRIEF DESCRIPTION OF THE DRAWINGS

In the course of the following detailed description reference will be frequently made to the accompanying drawings in which.

DETAILED DESCRIPTION OF THE PREFERRED EMBODIMENT

Figure 1:
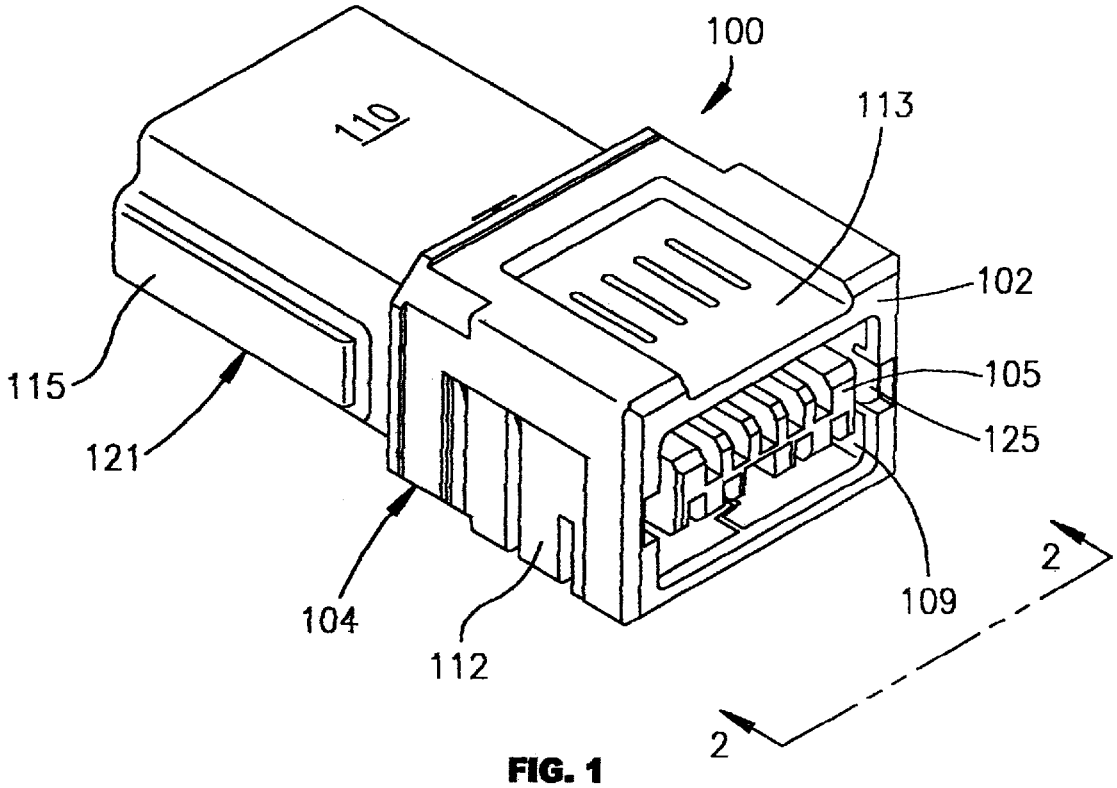
FIG. 1 is a perspective view of a plug connector incorporating the principles of the present invention.

FIG. 1 illustrates a plug connector 100 constructed in accordance with the principles of the present invention. The connector 100 has a mating face 102 that engages an opposing connector 200 such as that illustrated in FIG. 7. The plug connector 100 has an insulative body portion 104 that surrounds its plug portion 105. This body portion 104 is received within a complimentary cavity 206 that is defined between a shield 204 of the receptacle connector 200 that extends around one or more exterior surfaces 205 of the connector housing 203. This cavity 206 is further defined by an additional shield or housing 208 that is mounted to a circuit board 201 and which encircles the shielded receptacle connector 200 and forms the outer boundary of the cavity 206. As such, the cavity 206 may be considered to be a generally annular cavity.

Figure 2:
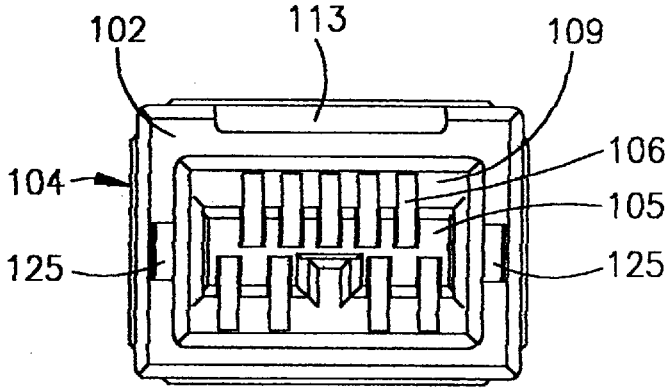
FIG. 2 is a front end view of the connector of FIG. 1, taken along lines 2—2.
Figure 3:
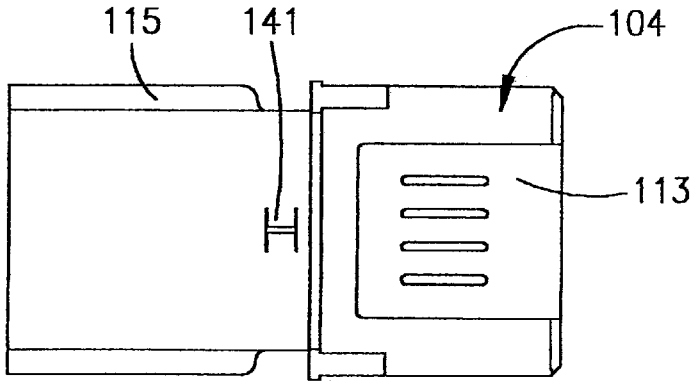
FIG. 3 is a top plan view of the connector of FIG. 1.

Returning to FIGS. 1 and 2, the connector housing 104 includes a central plug portion 105 that supports a plurality of conductive contacts 106 in opposition to like contacts 207 of the board receptacle connector 200. The contacts 106 are illustrated on top and bottom engagement surfaces of the plug portion 105. The connector housing 104 also includes an exterior housing portion 108 that encircles the plug portion 105 but in a spaced apart relation so that a generally annular cavity 109 is formed therebetween. This cavity 109 receives both the receptacle connector housing 203 and its shield 204. As mentioned above, in prior art connectors the entire connector housing was formed of the insulative material. When such a connector was subject to repeated engagement and disengagement with an opposing receptacle connector, the inner walls of the connector housing would experience wear due to the repeated contact with the receptacle connector that could also create debris within the connector. Over time, this wear may become great enough to effect the integrity of the engagement between the two connectors or the electrical performance of the connectors. Additionally, in such known connectors, a metal shield had to be applied to the exterior of the plug connector to provide conductive contact with the receptacle connector shield to prevent electromagnetic or radio frequency interference.

Figure 4:
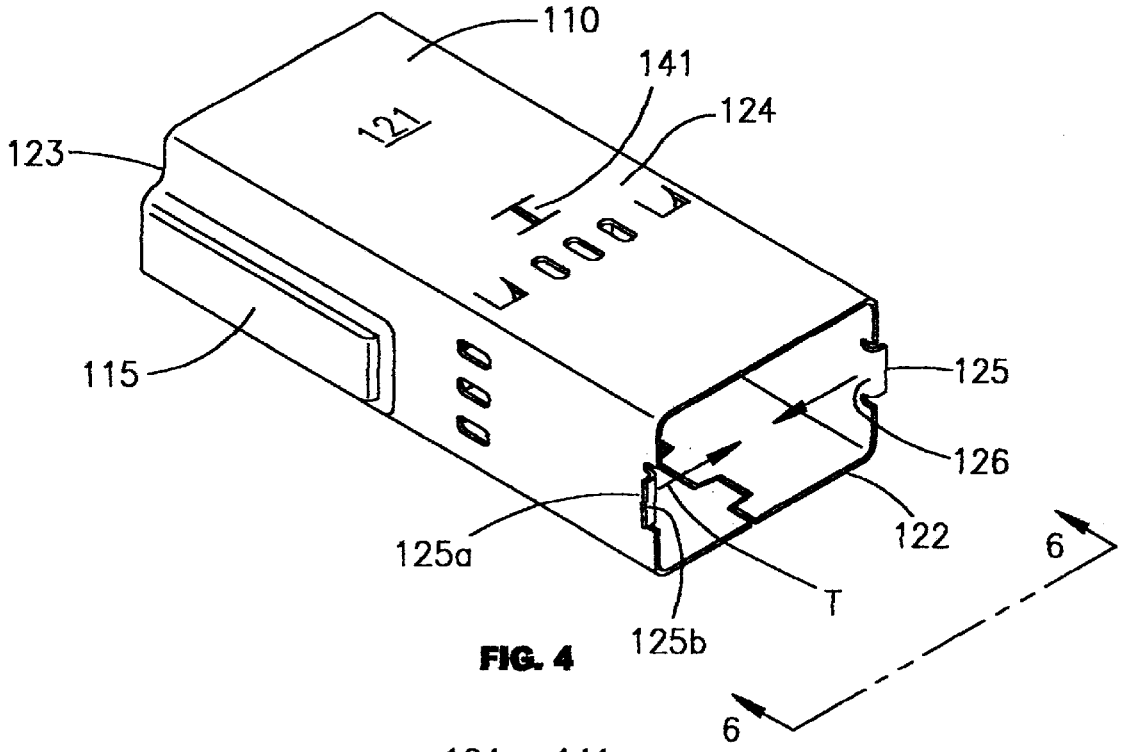
FIG. 4 is a perspective view of a metal insert shell used in the connector of FIG. 1.

The present invention is directed to a connector assembly that overcomes these shortcomings and provides beneficial results in use. In this regard, and as illustrated best in FIGS. 4–6, the present invention utilizes an extended metal shell member 110 that may be formed from a single metal blank 121. The shell 110 has an elongated hollow form, with a front end 122 and a rear end 123 that are interconnected by a body portion 124. This shell body portion 124 extends for substantially the entire length of the connector 100.

Figure 5:
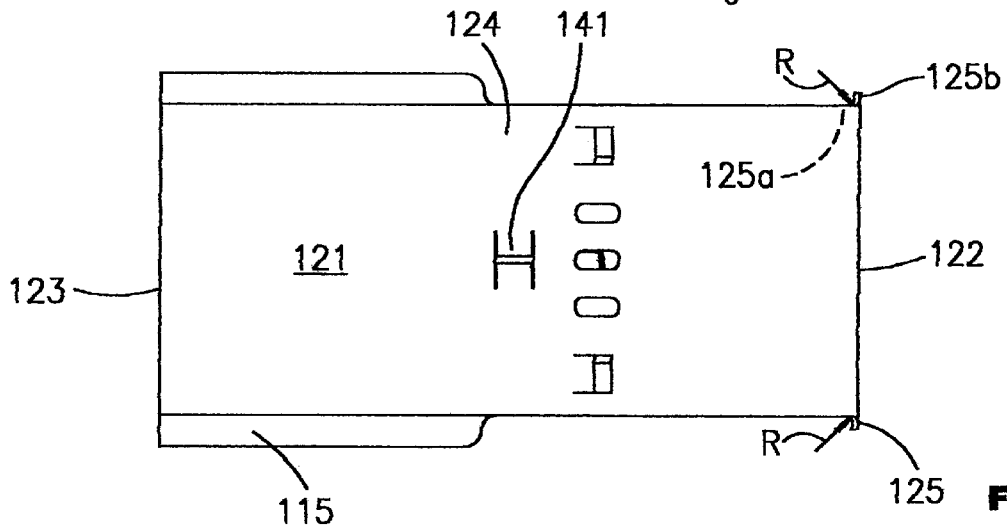
FIG. 5 is a top view of the shell of FIG. 4.
Figure 6:
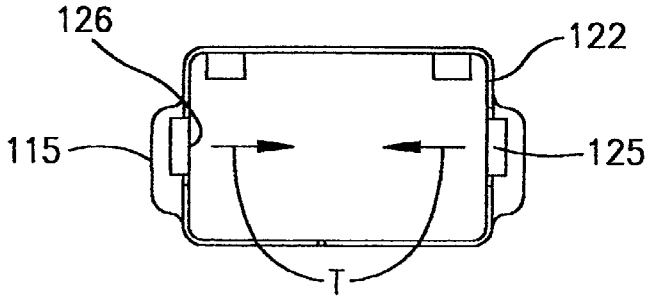
FIG. 6 is a front end view.

At its front end 122, the shell 110 is provided with at least one tab member 125, with two such tab members 125 being illustrated. These two tab members 125 may be considered as having distinct first and second portions 125*a*, 125*b*. The first portions 125*a* extend longitudinally along the shell 110 while the second portions 125*b* extend outwardly, or generally transverse to the longitudinal extent of the shell member 110. These second portions 125*b*, as seen in FIG. 5, extend within the plane of the front end 122 of the shell member 120.

These tab members 125 preferably are formed, such as by coining or bending, on a preselected radius R. The tab members 125 provide a number of advantages in the connectors of the present invention. They may be used to carry and support the shell member 110 during the manufacturing of the plug connector 100. They also provide a metal contact surface for engagement with the connector 200.

Figure 7:
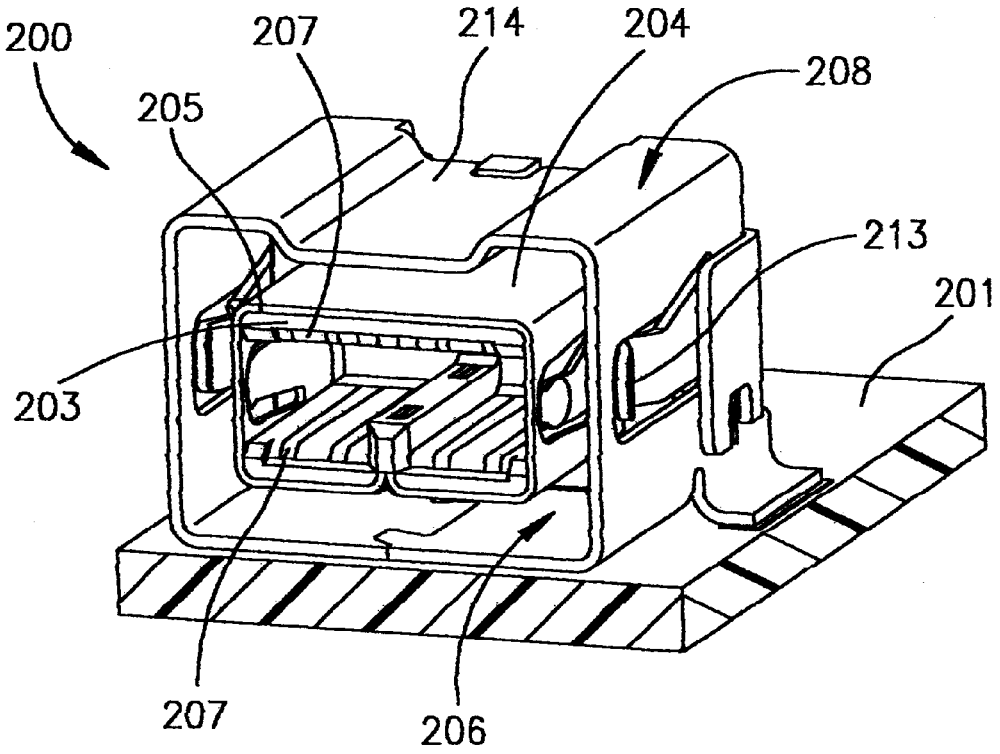
FIG. 7 is a perspective view of a connector assembly that is matable with the plug connector of FIG. 1.
Figure 8:
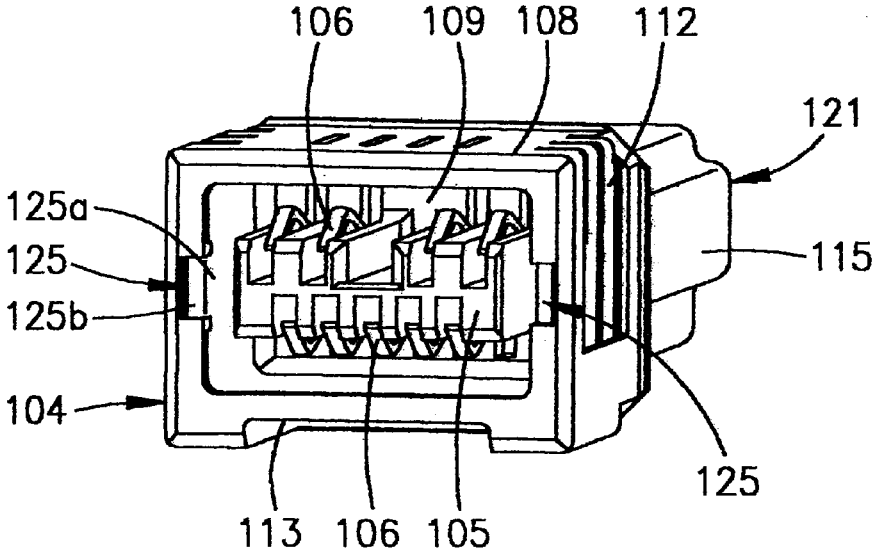
FIG. 8 is an enlarged end view of the plug connector of FIG. 1.

As seen in FIG. 7, the receptacle connector 200 has a first shield 204, and the entire connector is encompassed by a second shield 208. Both shield members 204, 208 have engagement means associated therewith. The shield 204 has a contact arm 210, while the shield 208 has a latch arm 212. Both of these arms 210, 212 are stamped from their respective metal shields 204, 208 and are preferably positioned, as illustrated in FIG. 7, in alignment with an in opposition to each other.

Figure 11:
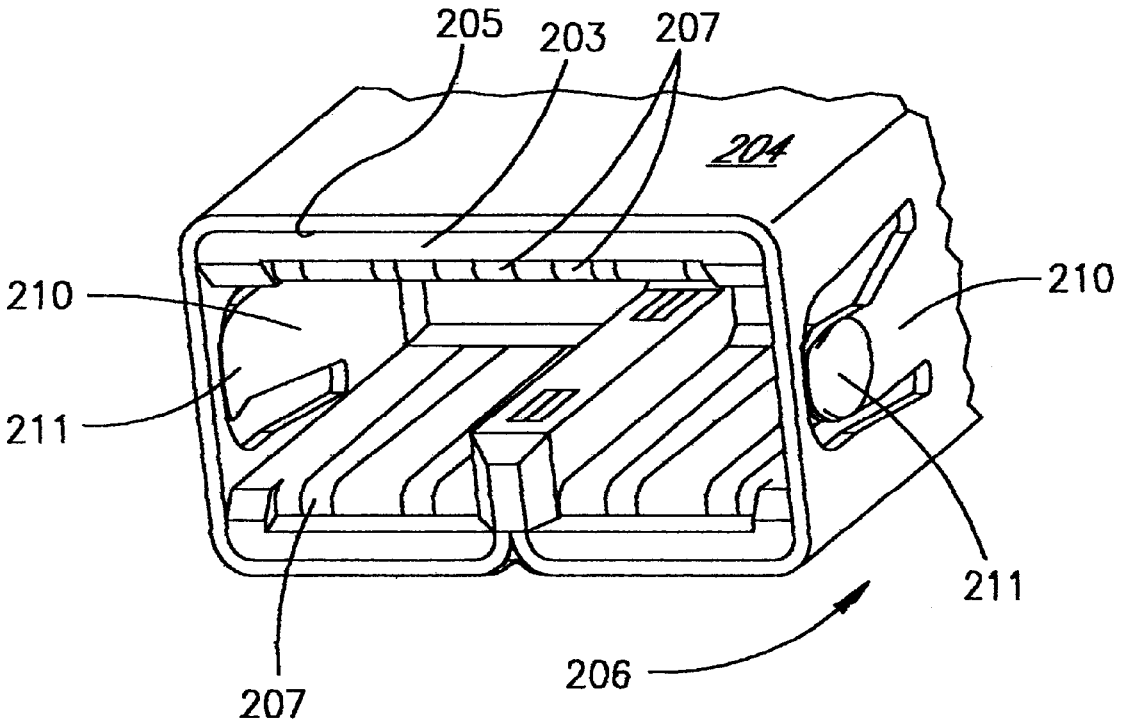

As illustrated best in FIG. 11, the shield contact arms 210 are cantilevered in their extent and have a raised, rounded engagement knob 211 which may be formed by coining. The shield latch arm 212 is also cantilevered in its extent from the body of the shield 208 and has an inwardly extending ramp 213 formed thereon. This ramp 213 engages and is received within a corresponding opposing recess 112 formed in the plug connector housing body 104. For polarization and alignment purposes, the receptacle connector 200 may have a depressed portion 214 formed in its shield 208 that engages a like-formed recess 113 formed in the top of the plug connector housing body 104.

Figure 9:
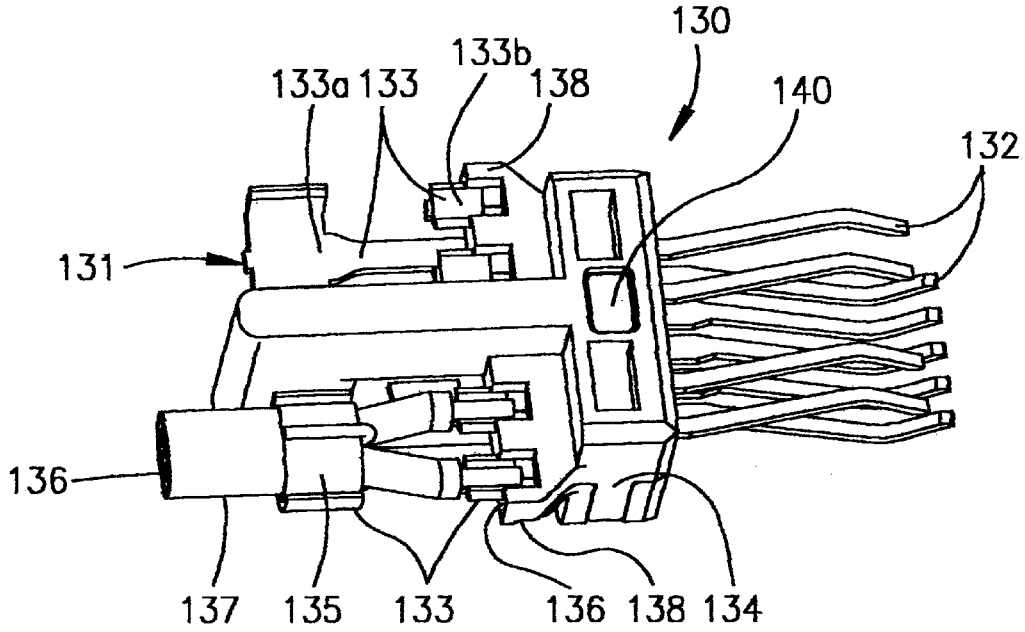
FIG. 9 is a perspective view of a terminal assembly used in conjunction with the connector of FIG. 1.
Figure 10:
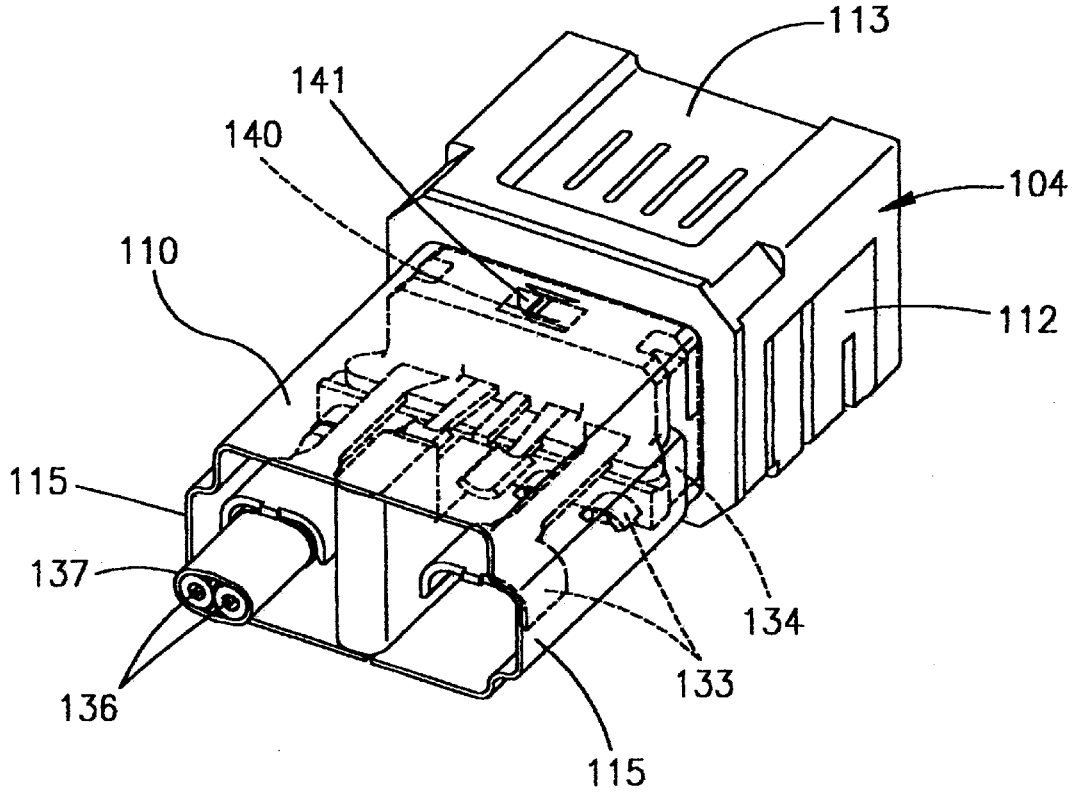
FIG. 10 is a rear perspective view of the connector of FIG. 1, illustrating the terminal assembly of FIG. 9, within the shell portion of the connector; and, FIG. 11 is an enlarged detail view of the opening of the connector of FIG. 7 with which the connectors of the invention mate.

FIG. 9 illustrates an internal terminal assembly 130 that may be used in the connectors of the present invention. In this assembly 130, a plurality of conductive terminals 131, each having contact portion 132 and termination portions 133 are held within a support structure 134. The termination portions 133 receive the grounding shield 135 and signal conductors 136 from a transmission line cable 137. This assembly 130 may be inserted into the metal shell 110, preferably from the rear end 123 thereof. In order to prevent shorting contact from occurring between the signal conductors 136 and the metal shell 110, portions 138 of the support structure 134 extend outwardly along the sides thereof in an extent that exceeds the normal side edges of the support structure 134. The metal shell 110 is therefore provided with longitudinal depressions 115 that extend lengthwise of the shell 110. These depressions 115 extend slightly outwardly, and as illustrated best in FIG. 10, they receive and accommodate the support structure extensions 138 so that the triangular arrangement of the ground terminal termination portion 133*a* and the signal terminal terminations portions 133*b* may be maintained. (FIG. 9.) The terminal assembly support structure 130 may include one or more recesses 140 that are adapted to receive other engagement tabs 141 formed in the shell 110 which may be pressed into the recesses 140 during assembly.

Returning to FIGS. 4–6, the engagement tabs 125 are preferably located on the shell 110 at a level and position such that they will oppose the contact arms 210 of the receptacle connector shield 204. As mentioned previously, these tab members 125 are formed with a slight radius R to define an arcuate engagement surface 126 that extends slightly inwardly in the direction of the arrows "T" in FIGS. 4 and 6. Because the knob portions 211 of the shield contact arms 210 are bent slightly inwardly, the knob portions 211 and the tab member engagement surfaces 126 will provide a positive engagement between the plug and receptacle connectors 100, 200. This engagement is between two opposing metal surfaces, thereby eliminating the abrasion and wear problems that occur between plastic and metal engagement surfaces. Importantly, these tab members 125 are formed as part of the plug connector shield 110 and thus serve as electrically conductive points of contact between the plug connector shield 110 and the shield 204 of the receptacle connector 200. This contact serves, in effect, as to maintain the overall shielding of the two connectors 100, 200 when engaged. It prevents electromagnetic and radio frequency interference problems by maintaining contact with the shield 204 of the receptacle connector 200. These tab members 125 with their engagement surface 126 provides an effective engagement means between the two connectors that is near-resistant and which does not increase the size of the connectors.

Although two such tab members 125 have been shown on the plug connector 100, one such tab member 125 may in some instances, be used effectively. Also, it is contemplated that the tab members 125 need not be limited to location on the plug connector or that the tab members are formed with a radius as compared to an arc or a chamfer or a lead in.

While the preferred embodiment of the invention have been shown and described, it will be apparent to those skilled in the art that changes and modifications may be made therein without departing from the spirit of the invention, the scope of which is defined by the appended claims.

We claim:

1. A plug connector for mating with an opposing connector, the plug connector having opposing front and rear faces, said plug connector comprising:

a plug body portion formed from an electrically insulative material, a plurality of conductive terminals being supported by the plug body portion;

a conductive shield member having an elongated body portion extending between opposing front and rear ends, the shield member rear end coinciding with the plug connector rear face, the shield member front end being disposed rearwardly of said plug connector front face, said shield member encircling said plug body portion and being spaced away therefrom so as to define an annular cavity extending around said plug body portion for receiving a complementary portion of the opposing connector when said plug and opposing connectors are mated together;

an electrically insulative housing disposed on a portion of said shield member, the housing extending between opposing front and rear edges thereof, said housing having a length that is less than the length of said shield member, said housing front edge being disposed forwardly of said shield member front end and coinciding with said plug connector front face, said housing rear edge being disposed rearwardly of said shield member front end, but forwardly of said shield member rear end so as to enclose only a portion of said shield member; and, said shield member including a pair of engagement tabs integrally formed therewith at said shield member front end, said engagement tabs extending lengthwise of said shield member and partially outwardly from said shield member transversely therefrom, said engagement tabs partially extending into said annular cavity and also into said housing and said engagement tabs further having ends that extend transversely into said housing.

2. The plug connector of claim 1, wherein said engagement tabs each include distinct first and second portions that extend in two different planes.

3. The plug connector of claim 2, wherein said engagement tab first portions extend longitudinally along said shield member and said engagement tab second portions extend at an angle to said shield member.

4. The plug connector of claim 3, wherein said housing front edge includes a pair of notches aligned with said engagement tab second portions.

5. The plug connector of claim 2, wherein said engagement tabs are bent along a radius to separate said first portions from said second portions.

6. The plug connector of claim 2, wherein each of said engagement tabs include an arcuate surface disposed at approximately where said first and second portions intersect.

7. The plug connector of claim 1, wherein said housing is molded over said shield member.

8. The plug connector of claim 1, wherein said plug connector terminals extend lengthwise and rearwardly within said shield member as part of a termination assembly, and said shield member includes a pair of recesses formed in said shield member that are aligned with said termination assembly in order to space said shield member away from said termination assembly.

9. The plug connector of claim 8, wherein said plug portion extends within said shield member in alignment with said engagement tab first positions.

* * * * *